US005366654A

United States Patent [19]

Van Den Brom et al.

[11] Patent Number: 5,366,654

[45] Date of Patent: Nov. 22, 1994

[54] RINSE AID COMPOSITIONS CONTAINING ALKYL POLYCYCLOSIDE AND A KETONE ANTIFOAMING AGENT

[75] Inventors: Guido C. Van Den Brom, Maarssen; Leendert Los, Houten, both of Netherlands

[73] Assignee: Unilever Patent Holdings, B.V., Rotterdam, Netherlands

[21] Appl. No.: 166,895

[22] Filed: Dec. 15, 1993

Related U.S. Application Data

[63] Continuation of Ser. No. 628,846, Dec. 11, 1990, abandoned.

[30] Foreign Application Priority Data

Dec. 11, 1989 [GB] United Kingdom ..... 8927956

[51] Int. Cl.[5] ..... C11D 3/00; C11D 3/22; C11D 3/60

[52] U.S. Cl. ..... 252/174.17; 252/173; 252/DIG. 14

[58] Field of Search ..... 252/174.17, 173, DIG. 14

[56] References Cited

U.S. PATENT DOCUMENTS

| | | | |
|---|---|---|---|
| 3,721,633 | 3/1973 | Ranauto | 252/527 |
| 3,985,670 | 10/1976 | Berg et al. | 252/117 |
| 4,147,652 | 4/1979 | Kaniecki | 252/156 |
| 4,483,779 | 11/1984 | Llenado et al. | 252/135 |
| 4,483,787 | 11/1984 | Jones et al. | 252/551 |
| 4,493,773 | 1/1985 | Cook et al. | 252/8.8 |
| 4,599,188 | 7/1986 | Llenado | 252/174.17 |
| 4,606,850 | 8/1986 | Malik | 252/528 |
| 4,627,931 | 12/1986 | Malik | 252/153 |
| 4,663,069 | 5/1987 | Llenado | 252/117 |
| 4,683,074 | 7/1987 | Malik et al. | 252/136 |
| 4,937,011 | 6/1990 | Schmid et al. | 252/99 |
| 4,948,845 | 8/1990 | Gagnon et al. | 525/409 |

FOREIGN PATENT DOCUMENTS

| | | | |
|---|---|---|---|
| 0136844 | 4/1985 | European Pat. Off. | C11D 3/22 |
| 1469124 | 3/1977 | United Kingdom | C11D 3/00 |
| 2128627 | 5/1984 | United Kingdom | C11D 1/825 |
| 8604349 | 7/1986 | WIPO | C11D 1/72 |
| 8605199 | 9/1986 | WIPO | C11D 1/62 |
| 8809369 | 12/1988 | WIPO . | |

*Primary Examiner*—Paul L. Lieberman
*Assistant Examiner*—Patricia L. Hailey
*Attorney, Agent, or Firm*—Cushman, Darby & Cushman

[57] ABSTRACT

Rinse aid compositions based on alkyl polyglycoside surfactants attack plastics, in particular polycarbonate, to a much lesser degree than rinse aid compositions based on other types of nonionic surfactants. It is preferred that the compositions also comprise an anti-foam agent, preferably a ketone having more than 25 carbon atoms.

8 Claims, No Drawings

RINSE AID COMPOSITIONS CONTAINING ALKYL POLYCYCLOSIDE AND A KETONE ANTIFOAMING AGENT

This is a continuation of application Ser. No. 07/628,846, filed on Dec. 11, 1990, which was abandoned upon the filing hereof.

The present invention relates to the field of detergent compositions, more in particular of rinse aid compositions. It especially relates to the use of alkyl polyglycoside surfactants as a rinse aids in an industrial mechanical warewashing process.

In an industrial warewashing process the soiled load is sprayed with an alkaline wash liquor and subsequently it is rinsed by spraying on hot water. Usually a rinse aid is added to the rinse water to facilitate the complete removal of the wash liquor from the load. The rinse aid also improves the appearance of the wash load after the wash process because it minimizes or prevents spots and stains from dried or evaporated rinse water droplets. Furthermore, the use of a rinse aid decreases the drying time by minimizing the amount of water adhered to the load.

The rinse aids which are known in the art are commonly neutral or acidic and comprise one or more surfactants to reduce the surface tension. In addition, they usually comprise an anti-foam compound. Low foaming nonionics are preferred, both as surfactants and as anti-foam compounds. Examples of commonly used nonionics are alkoxylated fatty alcohols, ethylene oxide/propylene oxide condensates and ethylene diamine based ethylene oxide/propylene oxide adducts.

In institutional kitchens not only plates and cutlery, but also plastic food storage systems, trays, tumblers and utensils are washed. Some of these are constructed of or comprise polycarbonate material. Under the severe conditions of the warewashing process most plastics are more or less susceptible to chemical attack. Especially in the case of polycarbonate, this may result in stress-cracking whereby the plastic object begins to show little cracks, which may be caused by the release of stress which was built into the object during the manufacturing process thereof- In extreme cases, the plastic materials may even become brittle.

The surfactant components in the rinse aid formulations have been found to contribute significantly to the attack of shaped plastic articles, more particularly polycarbonate articles, during the warewashing process.

It is therefore an object of the present invention to provide improved rinse aid formulations which have an improved compatibility towards plastics, in particular polycarbonate material.

We have now surprisingly found that alkyl polyglycoside nonionic surfactants attack plastics, in particular polycarbonate material, to a much lesser degree than other types of surfactants which are used in rinse aid formulations.

Accordingly, a first aspect of the present invention relates to the use of alkyl polyglycoside surfactants in a rinse aid composition having improved compatibility towards polycarbonate.

According to a second aspect, there is provided an aqueous detergent composition which comprises 2–30 % by weight of an alkyl polyglycoside surfactant and 0.01–5 % by weight of an anti-foam agent.

Alkyl polyglycosides are biodegradable nonionic surfactants which are well known in the art. Suitable alkyl polyglycosides according to the present invention have the general formula $C_nH_{2n+1}O(C_6H_{10}O_5)_xH$ wherein n equals 9–16, and $1<x<2$. Preferred are alkyl polyglycosides in which n equals 11–14 and $1.3<x<1.6$ because their properties form a good compromise between anti-foam activity and detergency. Alkyl polyglycoside surfactants are commercially available in a large variety. An example of a very suitable alkyl polyglycoside product is Planteren APG 600 (Trade Mark) ex Henkel Corporation, which is essentially an aqueous dispersion of alkyl polyglycosides wherein n equals approximately 13 and x equals about 1.4.

Preferably, rinse aid compositions of the present invention also contain an anti-foam compound. This may be a conventional anti-foam agent such as calcium or magnesium salts of fatty acids. Low foaming nonionic surfactants may also be used, but these are not preferred in view of their limited compatibility towards polycarbonate. In their place, we advantageously used long chain ketones having more than 25 carbon atoms. These types of anti-foam compounds have been described in more detail in the European patent application 324,339 (Henkel). The ketone may have, for example, 33 to 45 carbon atoms. Preferably, the anti-foam ketone is present in the form of a dispersion in a liquid organic carrier, such as a branched fatty alcohol having 8 to 24 carbon atoms. Such compositions are commercially available, for instance from Henkel as Dehypon 2429.

The combination of an alkyl polyglycoside surfactant with such a long chain ketone anti-foam surprisingly proved to have an excellent compatibility towards polycarbonate.

Anti-foam agents which were found to be less suitable are for example Degressal SD 20 and SD 30 (ex BASF), which caused breakage of a polycarbonate strip in the test described below within 1 hour and within 24 hours, respectively.

The compositions of the present invention may additionally comprise 0.1 to 1.0% by weight of a thickening agent to improve their stability against phase separation. Suitable conventional thickening agents are for example cross-linked acrylate polymers such as Carbopol 941 ex Goodrich, clays and high molecular weight polysaccharide gums. Xanthan gum is the preferred thickening agent. Keltrol F and Kelzan S are examples or commercially available xanthan gums, which may be obtained from Kelco.

The invention will now be further illustrated by means of the following examples, in which the amounts are given as % by weight, unless otherwise indicated.

EXAMPLES 1–16

The compatibility of various types of nonionic surfactants for polycarbonate was tested by applying a droplet of the compositions onto strips of $10\times1\times0.21$ cm of polycarbonate material under a stress force causing them to bend over 8 mm in the middle, and determining the contact time required before cracking occurred. The results are given in Table I in which "x" denotes that the strip was broken within the period of time indicated, and "—" means that the strip was still intact.

TABLE I

| Example | Surfactant type | Interaction: 1 hr | 24 hrs |
|---|---|---|---|
| 1 | Ethoxylated nonionic[1]) | x | x |
| 2 | Ethoxylated nonionic[2]) | x | x |

TABLE I-continued

| Example | Surfactant type | Interaction: 1 hr | 24 hrs |
|---|---|---|---|
| 3 | Ethoxylated nonionic[3]) | x | x |
| 4 | Ethoxylated nonionic[4]) | x | x |
| 5 | Ethoxylated nonionic[5]) | x | x |
| 6 | Alkoxylated fatty amine[6]) | x | x |
| 7 | Ethylene/propylene oxide block polymer[7]) | x | x |
| 8 | Alkyl polyglycolether carboxylic acid/carboxylate[8]) | x | x |
| 9 | Idem[9]) | x | x |
| 10 | Idem[10]) | - | x |
| 11 | $C_{12.5}$ Alkyl polyglycoside[11]) x = 1.4 | - | - |
| 12 | $C_{12}$–$C_{14}$ Alkyl polyglycoside[12]) x = 1.4 | - | - |
| 13 | $C_8$–$C_{10}$ Alkyl polyglycoside[13]) x = 1.6 | - | - |
| 14 | Alkyl polyglycoside[14]) | - | - |
| 15 | Alkyl polyglycoside[15]) | - | - |
| 16 | Alkyl polyglycoside[16]) | - | - |

[1])Synperonic LF/RA30 ex ICI, [2])Dehypon LS 45 ex Henkel, [3])Dehypon LS 36 ex Henkel, [4])Lutensol LF 221 ex BASF, [5])Triton DF 12 ex Rohm & Haas, [6])Triton CF 32 ex Rohm & Haas, [7])Pluronic PE 6200 ex BASF, [8]) Alkypo TPR ex Chem-Y, [9])Alkypo RLMQ 38 ex Chem-Y, [10])Alkypo 2717 ex Chem-Y, 11)APG 500 ex Henkel Corp., [12])Planteren APG 600 ex Henkel KGaA, [13])Planteren APG 600 ex Henkel KGaA, [13])Planteren APG 225 ex Henkel KGaA, [14])Lutensol GD 50 ex BASF, [15])Lutensol GD 70 ex BASF, [16])Triton CG 110 ex Rohm & Haas. All these names are believed to be Trade Marks.

Table I shows that alkyl polyglycoside type surfactants have a good compatibility towards polycarbonate, compared to other types of surfactants.

EXAMPLES 17–20

The following aqueous rinse aid formulations were prepared:

TABLE II

| Examples | 17 | 18 | 19 | 20 |
|---|---|---|---|---|
| Planteren APG 600 (50%) | 10.0 | — | 10.0 | 10.0 |
| Lutensol GD 50 (50%) | — | 20.0 | — | — |
| Dehypon KE2429 (Henkel) | 10.0 | 10.0 | 10.0 | 12.5 |
| Keltrol F | 0.5 | — | 0.5 | 0.5 |
| Kelzan S | — | 0.5 | — | — |
| Calcium stearate | — | — | — | 1.5 |
| Water | 79.5 | 69.5 | 79.5 | 75.5 |

In these compositions, Planteren (Trade Mark) APG 600 is a 50% by weight aqueous dispersion of an alkyl polyglycoside having the general formula given above, wherein n equals approximately 13, and x equals about 1.4. Lutensol GD 50 is a similar alkyl polyglycoside ex BASF. Dehypon 2429 is an anti-foam agent available from Henkel and comprising a long chain ketone dispersed in a branched fatty alcohol. Keltron F and Kelzan S are high molecular weight polysaccharide xanthan gums which are used as thickening agents.

For several rinse aid formulations the compatibility towards polycarbonate was tested according to the method given above. The following results were obtained:

TABLE III

| Interaction: | 1 hr | 24 hrs |
|---|---|---|
| Example 17 | - | - |
| Example 18 | - | - |
| Example 19 | - | - |
| Example 20 | - | - |
| Comparative Example A | - | x |
| Comparative Example B | x | x |

Comparative example A was a conventional rinse aid formulation based on 20% by weight of an alkoxylated ternary amine (Triton CF32) and 20% by weight of an ethylene/propylene oxide block polymer (Pluronic PE 6200). Comparative example B was a commercial formulation based on 15% by weight Dehypon LS 45 and 15% by weight Dehypon LS 36, two ethoxylated nonionic surfactants.

Table III shows that the rinse aid formulations 17 to 20 according to the present invention have an improved compatibility towards polycarbonate than formulations A and B, which are not based on alkyl polyglycoside surfactants.

We claim:

1. In a ware washing process wherein polycarbonate ware is sprayed and cleaned with an alkaline wash liquor and then rinsed with hot water including a rinse aid, the improvement whereby chemical attack of the polycarbonate care is minimized, said improvement comprising using, as the rinse aid, an alkyl polyglycoside surfactant having the formula $C_nH_{2n+1}O(C_6H_{10}O_5)_xH$ wherein n equals 9–16, and $1<x<2$ together with an anti-foaming agent which is a ketone having more than 25 carbon atoms.

2. A process according to claim 1 wherein the alkyl polyglycoside surfactant is one in which n equals 11–14 and $1.3<x<1.6$.

3. A process according to claim 1 wherein the rinse aid comprises:

2–30% by weight of an alkyl polyglycoside surfactant having the formula $C_nH_{2n+1}O(C_6H_{10}O_5)_xH$ wherein n equals 9–16, and $1<x<2$ and 0.01–5% by weight of an anti-foam agent which is a ketone having more than 25 carbon atoms, said ketone being in the form of a dispersion in a liquid organic carrier.

4. A process according to claim 1, wherein the anti-foam agent is a ketone having 33 to 45 carbon atoms.

5. A process according to claim 4, wherein the anti-foam agent is a symmetrical ketone.

6. A process according to claim 1, wherein the anti-foam agent is in the form of a dispersion in a liquid organic carrier which is a branched fatty alcohol having 8 to 24 carbon atoms.

7. A process according to claim 1, wherein the rinse aid also includes 0.1–1.0 % by weight of a thickening agent.

8. A process according to claim 7, where the rinse aid includes a xanthan gum as the thickening agent.

* * * * *